US005988785A

United States Patent [19]

Katayama

[11] Patent Number: 5,988,785

[45] Date of Patent: Nov. 23, 1999

[54] RECORDING APPARATUS AND METHOD FOR DRIVING RECORDING HEAD ELEMENT GROUPS IN A PARTIALLY OVERLAPPED MANNER

[75] Inventor: Akira Katayama, Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/306,977

[22] Filed: Sep. 16, 1994

[30] Foreign Application Priority Data

Sep. 20, 1993 [JP] Japan ..... 5-233217

[51] Int. Cl.[6] ..... B41J 29/38

[52] U.S. Cl. ..... 347/13

[58] Field of Search ..... 347/9, 12, 13, 347/180, 183, 182, 196, 237, 68

[56] References Cited

U.S. PATENT DOCUMENTS

| | | | |
|---|---|---|---|
| 4,300,144 | 11/1981 | Isayama et al. | 347/68 |
| 4,313,124 | 1/1982 | Hara | 347/57 |
| 4,345,262 | 8/1982 | Shirato et al. | 347/57 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,578,687 | 3/1986 | Cloutier et al. | 347/44 |
| 4,608,577 | 8/1986 | Hori | 347/66 |
| 4,704,616 | 11/1987 | Nakamura | 347/183 |
| 4,723,129 | 2/1988 | Endo et al. | 347/56 |
| 4,740,796 | 4/1988 | Endo et al. | 347/56 |
| 5,006,866 | 4/1991 | Someya | 347/196 |
| 5,173,717 | 12/1992 | Kishida et al. | 347/13 |
| 5,353,051 | 10/1994 | Katayama et al. | 347/13 |
| 5,359,352 | 10/1994 | Saita et al. | 347/182 |

FOREIGN PATENT DOCUMENTS

| | | |
|---|---|---|
| 54-056847 | 5/1979 | Japan . |
| 59-123670 | 7/1984 | Japan . |
| 59-138461 | 8/1984 | Japan . |
| 60-071260 | 4/1985 | Japan . |
| 1285356 | 11/1989 | Japan . |

*Primary Examiner*—N. Le
*Assistant Examiner*—L. Anderson
*Attorney, Agent, or Firm*—Fitzpatrick, Cella, Harper & Scinto

[57] ABSTRACT

A recording apparatus for recording by using a recording head having a plurality of recording elements comprises a generation circuit for generating an enable signal for enabling the drive of the recording elements, and a supply circuit for sequentially supplying the generated enable signals to recording element groups each including one or a plurality of adjacent recording elements. The supply circuit supplies the enable signals to the adjacent recording element groups in partially overlapped manner whereby the enable signals partially overlap.

29 Claims, 15 Drawing Sheets

RECORDING APPARATUS AND METHOD FOR DRIVING RECORDING HEAD ELEMENT GROUPS IN A PARTIALLY OVERLAPPED MANNER

BACKGROUND OF THE INVENTION

1. Field of the Invention

The present invention relates to recording apparatus and method, and more particularly to ink jet recording apparatus and method for discharging fine ink droplets toward a recording medium such as a sheet to record characters or images thereon, and further particularly to recording apparatus and method which use as many nozzles as the number corresponding to a recording width of the recording medium.

2. Related Background Art

An ink jet recording apparatus for discharging fine ink droplets to record data has been known. This recording apparatus has many advantages over other recording apparatuses such as high recording speed, ease of colorization, plain paper recording, low noise and high recording quality.

Such an ink jet recording apparatus has a recording head which comprises discharge ports (or outlets) for discharging inks, nozzles connected to the discharge ports and energy generation means arranged at portions of the nozzles to generate energy to discharge the inks in the nozzles. The recording head selectively discharges ink droplets from the discharge ports in accordance with input record information to form characters and images on the recording medium.

However, in such a prior art ink jet recording head, since a plurality of nozzles communicate with a single common liquid chamber, nozzles mutually interfere with each other and a discharge characteristic of the ink droplets is deteriorated.

The mutual interference means an affect of the first discharge to the second discharge from the recording head when ① ink is discharged from a particular nozzle at the first discharge, and ② ink is discharged from a nozzle adjacent to the nozzle of ① at the second discharge. Namely, it means a phenomena in which the quantity of discharge of the ink or the velocity of discharge of the ink at the second discharge changes between the operation ② immediately after the operation ① and the operation ② without the operation ① or sufficiently long interval after the operation ①.

The deterioration of the discharge characteristic means that a change in the quantity of discharge of the ink or the velocity of discharge is large so that the quality of the characters or images is deteriorated. The change in the quality of discharge of the ink has a great affect to the quality. The larger the number of nozzles which concurrently discharge the ink in the operations ① and ② is and the shorter a distance between a rear end of a separation wall of the nozzles and a rear surface of the common liquid chamber in the structure of the recording head is, the more remarkably does the phenomenon occur.

The causes of the mutual interference are explained with reference to FIGS. 3A and 3B which illustrate the structure of the recording head and FIGS. 4A to 4C which illustrate the mutual interference between the nozzles. FIGS. 3A and 3B show an ink jet (bubble jet) recording head. Numeral 300 denotes a resistor which is an energy generator, numeral 301 denotes a nozzle, numeral 302 denotes a discharge port, numeral 303 denotes a common liquid chamber, numeral 304 denotes a filter, numeral 305 denotes a silicon (Si) substrate, numeral 306 denotes an aluminum (A1) substrate, numeral 307 denotes an ink supply tube, numeral 308 denotes a flexible cable and numeral 309 denotes a nozzle separation wall. FIG. 4A shows a timing t=0 to conduct a first discharge of the operation ① by a first pulse P1 and a timing $t=t_s$ to conduct a second discharge of the operation ② by a second pulse P2. Each of P1 and P2 has a pulse width of 10 μsec and a voltage applied to the resistor is 30V. FIG. 4B shows a portion of FIG. 3B and illustrates the propagation of an ink pressure at a time immediately before the drive of the heat generators of the nozzles No. 5 to No. 8 by the first pulse P1.

By the heat generated by the heat generators #1 to #4 (or No. 1 to No. 4), bubbles 321 are generated and the ink is discharged in the direction C. At the same time, a small amount of ink flows back to the common liquid chamber 303 as shown by an arrow D. By this phenomenon, a small amount of ink extends in the direction of discharge, although the ink is not fully discharged in the direction E, from the discharge ports 302 of the nozzles #5 et seq. Namely, as shown in FIG. 4C, a meniscus 322 which is an interface between the ink and atmosphere exhibits slightly convex. Thereafter, the nozzles #1 to #4 normally discharge the ink.

However, when the pulse P2 is applied at $t=t_s=13$ μsec to discharge the ink from the nozzles #5 to #8, the discharge is conducted while the meniscus 322 is convex, and the volume of discharge of the ink from the nozzles #5 to #8 is larger by ΔV than that when the pulse P2 is applied without the pulse P1. Namely, larger ink droplets are discharged.

It has been known that when the quantity of discharge of the ink of the adjacent recording point changes approximately 10%, the deterioration of the record quality can be visually recognized.

It is difficult to precisely measure the increment of the quantity of discharge of the ink from the nozzle #5, it is estimated as follows by approximation calculation. In the condition of FIG. 4B, the extension of the meniscus 322 from the nozzle #5 is 10 μm. The actual nozzle sectional size is 20 μm×25 μm but it is approximated by a cylinder having a diameter of 25 μm. Further, since the extension of the meniscus 322 is approximated to a portion of a sphere as shown in FIG. 4C by the microscope observation, the increment by the extension of the meniscus 322 is given by $$\Delta V1=2.98 \text{ (pico liters)}$$

Under the non-discharge condition of the ink, the meniscus 322 is set to be slightly convex and recessed by 2 μm. A distance (or difference) to the tip end of the nozzle is given by $$\Delta V2=0.16 \text{ (pico liters)}$$

Thus, the increment of the quantity of discharge of the ink is given by $$\Delta V=\Delta V1+\Delta V2=3.14 \text{ (pico liters)}$$

Since the normal quantity of discharge of the ink is approximately V=28 (pico liters), the change of the ink droplets is $$\Delta V/V=11.2 \text{ (\%)}$$

and the recording quality is deteriorated.

In the above description, it is assumed that the position of the meniscus 322 of the nozzle #5 changes with time and the pulse P2 is applied at the most extended timing. However, it has been proved that the change in the quantity of the ink droplets is larger when the pulse P2 is applied at a slightly earlier timing. This is considered because there is a time lag from the application of the voltage to the heat generator to the generation of the bubbles on the heat generator and the force which the ink receives in the direction of discharge is larger when the meniscus 322 moves toward the extension than when the meniscus 322 is at the most extended state.

When the pulse P2 is applied around t=40 μsec, the change in the quantity of the ink droplets is negative as opposed to the above case. This is considered because the meniscus 322 which has once been convex recovers by a surface tension of the ink and becomes concave rather than the normal state by a kinetic energy, and the arrows D and E in FIG. 4B are of opposite direction at the timing of the extinguishment of the bubbles generated at the nozzles #1 to #4.

One solution to those problems is disclosed in U.S. Pat. No. 4,578,687. In this method, an atmosphere opening for the ink is provided at a portion of the recording head to divert the change in the pressure in the common liquid chamber to the atmosphere when a particular nozzle discharges the ink to prevent the interference to other nozzles. This method, however, has disadvantages of introduction of fine dusts from the atmosphere opening, the inducement of non-discharge of the ink due to the change of material property by the evaporation of the ink, and the inability of the discharge due to the adhesion of the ink. In order to avoid those problems, the apparatus should be very complex.

Means for retaining bubbles for the interference of the pressure of a portion of the common liquid chamber is disclosed in Japanese Laid-Open patent application Ser. No. 1-285356 but it is difficult to always retain a constant volume of bubbles.

As an approach to minimize the occurrence of the problem due to the mutual interference, it has been proposed to make a length d from a rear of the energy generator 300 shown in FIG. 3B to a rear of the common liquid chamber 303 sufficiently long. In an experiment, the mutual interference was minimized by setting the length d longer than 6.0 mm. However, this method is against a desire to reduce the size of the recording head to make the recording apparatus compact. Further, since the Si substrate is an expensive component, the increase of the size of the recording head leads to the increase of the cost of the apparatus.

As a method for preventing the mutual interference by the vibration of the meniscus of the non-discharge nozzle, a method of simultaneously driving all nozzles has been proposed. However, in this method, the larger the number of nozzles is, the larger is the capacity of the driving power for the resistor which is the energy generator. As a result, the size of the apparatus increases and the cost of the apparatus increases.

The mutual interference may also be prevented by providing a time interval after the discharge from one nozzle to the discharge timing of the adjacent block which is long enough for the meniscus to return to the normal state rather than convex or concave. However, this method is in contrast to the requirement of high recording speed and a step appears prominently in the recorded characters and images due to the lag in the discharge timing and the recording quality is deteriorated.

SUMMARY OF THE INVENTION

It is an object of the present invention to provide a recording apparatus and method which allow high quality and high speed recording.

It is another object of the present invention to provide a recording apparatus and method which are compact and of low cost.

In order to achieve the above objects, the present invention provides a recording apparatus for recording by using a recording head having a plurality of recording elements, comprising generation means for generating an enable signal for enabling the drive of said recording elements, and supply means for sequentially supplying the generated enable signals to recording element groups each including one or a plurality of adjacent recording elements, said supply means supplying the enable signals to the adjacent recording element groups in partially overlapped manner whereby the enable signals partially overlap.

The present invention further provides a recording method for recording by using a recording head having a plurality of recording elements, comprising the steps of generating an enable signal for enabling the drive of said recording elements, supplying the generated enable signal to one of recording element groups each including one or a plurality of adjacent recording elements; and supplying the generated enable signal to other recording element group adjacent to said one recording element group in a partial overlapped manner to the enable signal supplied to said one recording element group.

The present invention further provides an ink jet recording apparatus for recording by discharging ink, comprising a recording head having a plurality of discharge ports for discharging the ink, energy generation elements provided one for each discharge port for discharging the ink, flow paths communicating with said discharge ports and a common liquid chamber to which said flow paths commonly communicate; generation means for generating an enable signal for enabling the drive of said recording elements; and supply means for sequentially supplying the generated enable signals to recording element groups each including one or a plurality of adjacent recording elements, said supply means supplying the enable signals to the adjacent recording element groups in partially overlapped manner whereby the enable signals partially overlap.

The present invention further provides a recording method for recording by discharging ink, comprising the steps of preparing a recording head having a plurality of discharge ports for discharging the ink, energy generation elements provided one for each discharge port for discharging the ink, flow paths communicating with said discharge ports and a common liquid chamber to which said flow paths commonly communicate; generating an enable signal for enabling the drive of said recording elements; supplying the generated enable signal to one of recording element groups each including one or a plurality of adjacent recording elements; and supplying the generated enable signal to other recording element group adjacent to said one recording element group in a partial overlapped manner to the enable signal supplied to said one recording element group.

The present invention further provides a recorded product having ink deposited thereon manufactured by a recording method, said recording method comprising the steps of preparing a recording head having a plurality of discharge ports for discharging the ink, energy generation elements provided one for each discharge port for discharging the ink, flow paths communicating with said discharge ports and a common liquid chamber to which said flow paths commonly communicate; generating an enable signal for enabling the drive of said recording elements; supplying the generated enable signal to one of recording element groups each including one or a plurality of adjacent recording elements; and supplying the generated enable signal to other recording element group adjacent to said one recording element group in a partial overlapped manner to the enable signal supplied to said one recording element group.

In accordance with the present invention, the recording element groups are driven in the partially overlapped manner, that is, in continuous manner so that the registration shift does not occur in the recorded image. In the ink jet recording, the irregularity of optical density of the recorded image which would otherwise be generated by the ink returned to the rear of the nozzle when the ink is discharged from the nozzle and a pressure wave propagated to the rear of the nozzle is prevented, and the high quality and high speed recording is attained without prominent optical density irregularity.

DETAILED DESCRIPTION OF THE PREFERRED EMBODIMENTS

The recording apparatus and method of the present invention are now explained with reference to the drawings.

<Embodiment 1>

Figure 1:
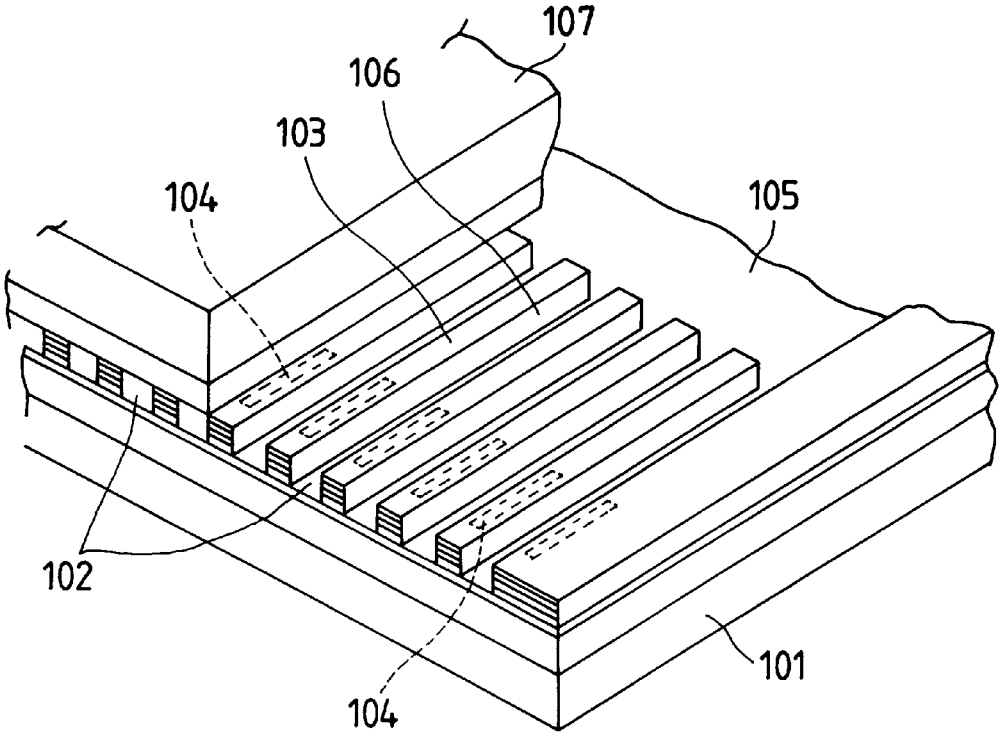
FIG. 1 shows a structure of a recording head in one embodiment.
Figure 2:
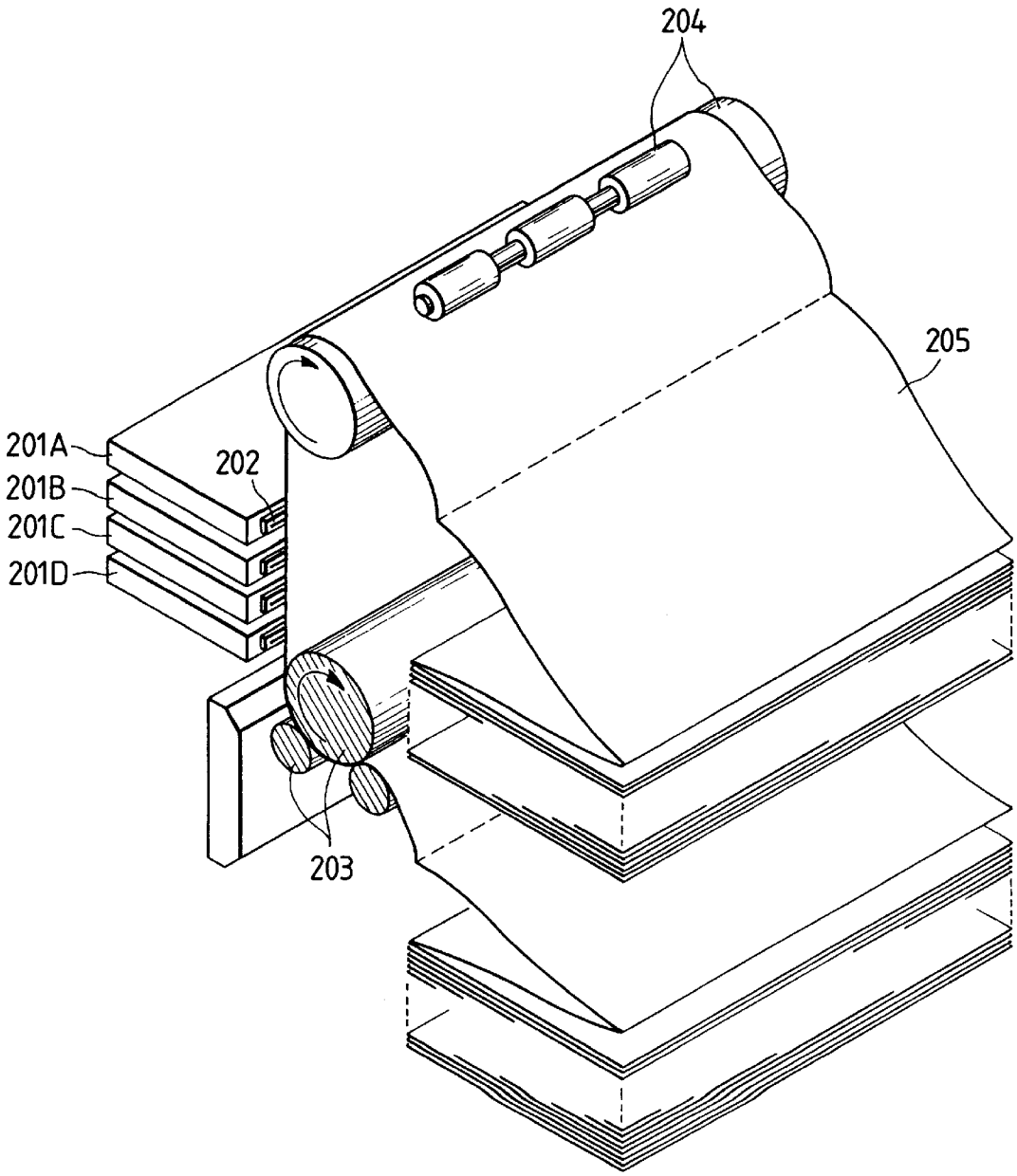
FIG. 2 shows a perspective view of major portions of a bubble jet recording apparatus of the embodiment.
Figure 3A:
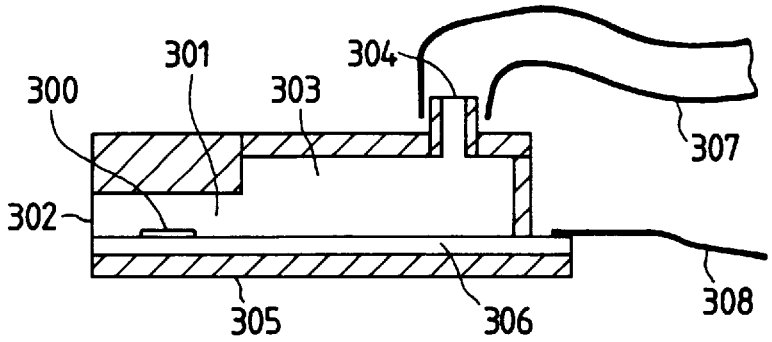
FIGS. 3A and 3B show a structure of a recording head.
Figure 3B:
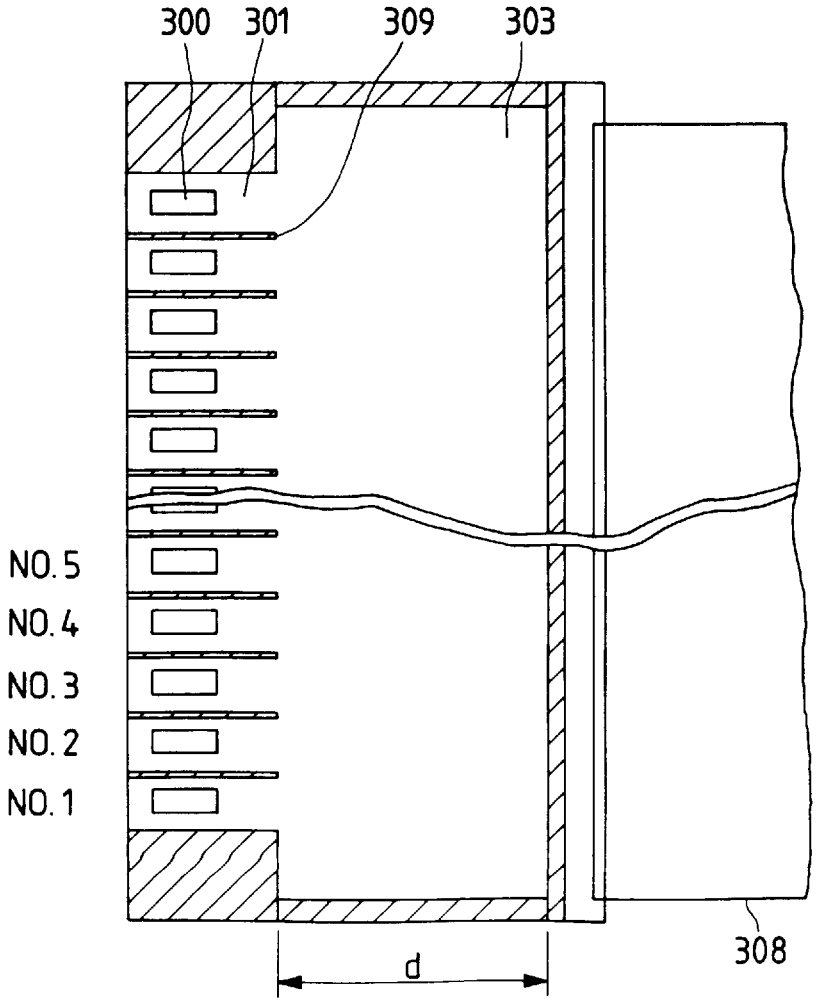
Figure 4A:
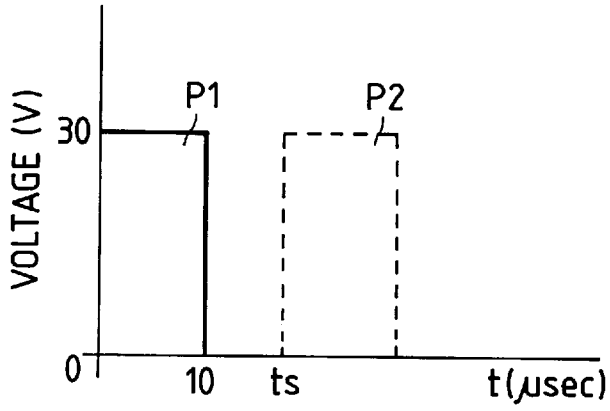
FIGS. 4A to 4C illustrate mutual interference among nozzles.
Figure 4B:
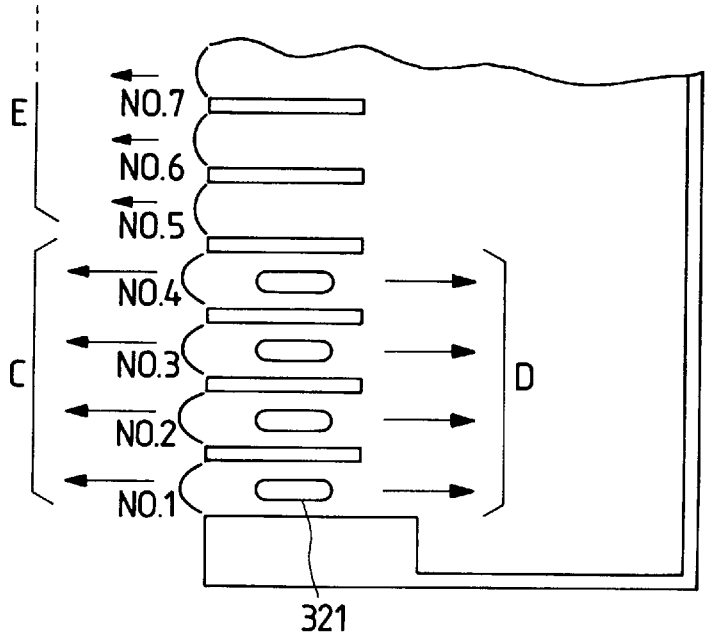
Figure 4C:
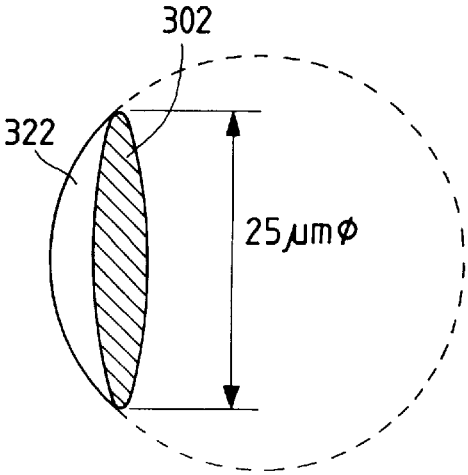

FIG. 1 shows a diagram for illustrating an ink jet recording head used in the present embodiment, and particularly a structure of a bubble jet recording head. FIG. 2 shows a perspective view of major parts of the bubble jet recording apparatus.

In FIG. 2, numerals 201A to 201D denote a plurality of continuous recording heads, with 201A being for black (Bk), 201B being for cyan (C), 201C being for magenta (M) and 201D being for yellow (Y). Numeral 202 denotes a recording head nozzle and numerals 203/204 denote sheet (a recording medium 205 as a continuous form) feed rollers A/B.

In FIG. 1, a heat generator (heater) 104 is provided for each nozzle 106 and droplets are discharged from a discharge port 102 by applying predetermined energy from a head drive circuit to the heater 104.

The heater 104 is formed on a silicon substrate 101 in a process similar to that of semiconductor device manufacture. Numeral 103 denotes a nozzle separation wall to form the nozzles 106, numeral 105 denotes a common liquid chamber for supplying ink to the nozzles 106, and numeral 107 denotes a top plate.

Figure 5A:
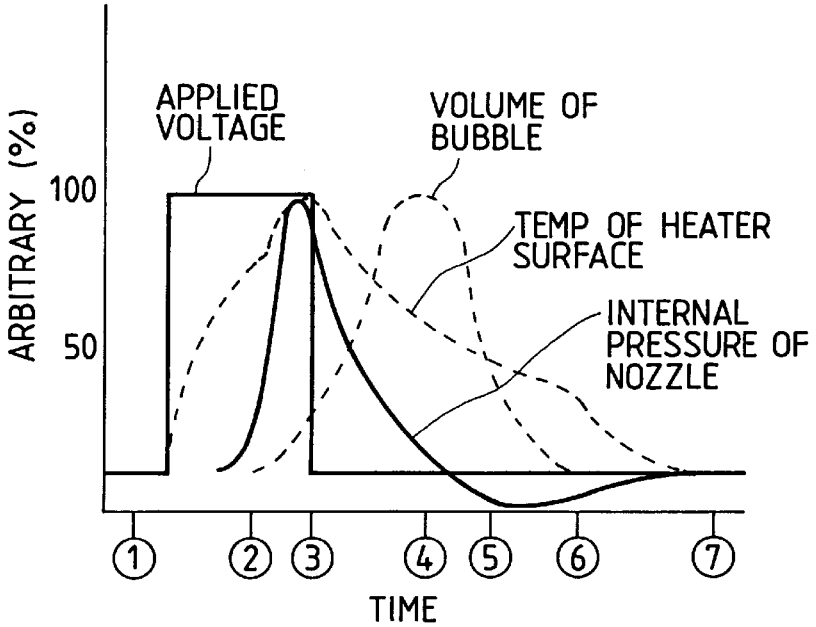
FIGS. 5A and 5B show relations of heater energization and ink discharge of the recording head.
Figure 5B:
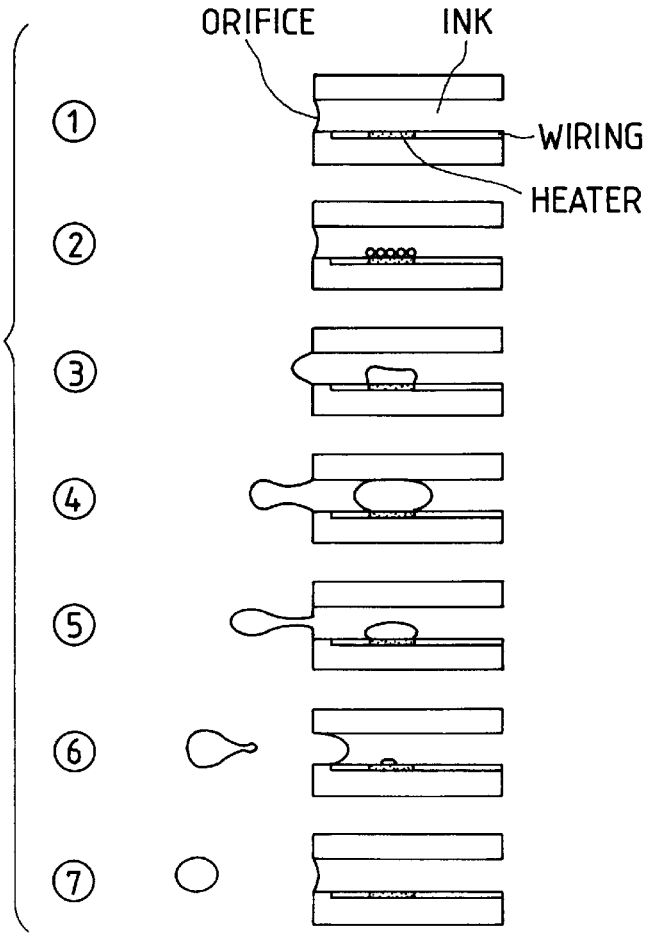

FIGS. 5A and 5B show relations of the energization of the heater of the recording head and the discharge of the ink, and the discharge states of the ink in the energization times ① to ⑦ in FIG. 5A are shown in ① to ⑦ in FIG. 5B.

Figure 7:
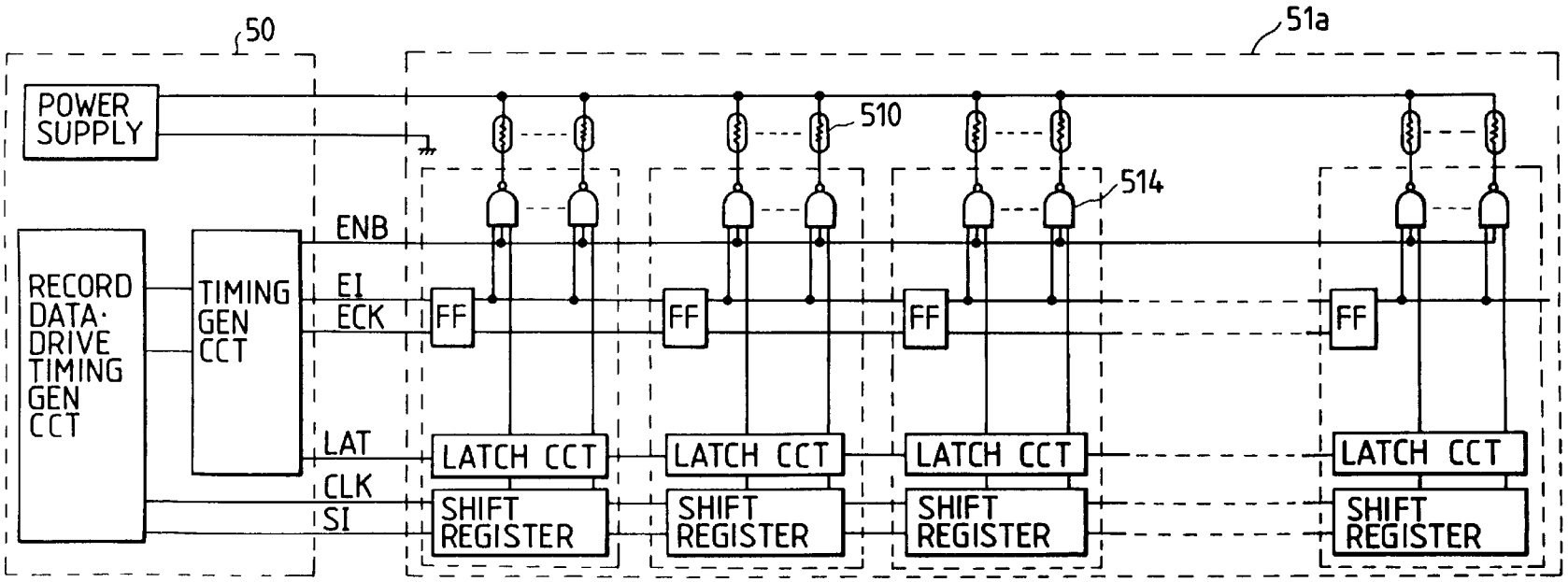
FIG. 7 PRIOR ART
FIG. 7 shows an electrical block diagram of one example of a prior art ink jet recording apparatus.
Figures 8A, 8B:
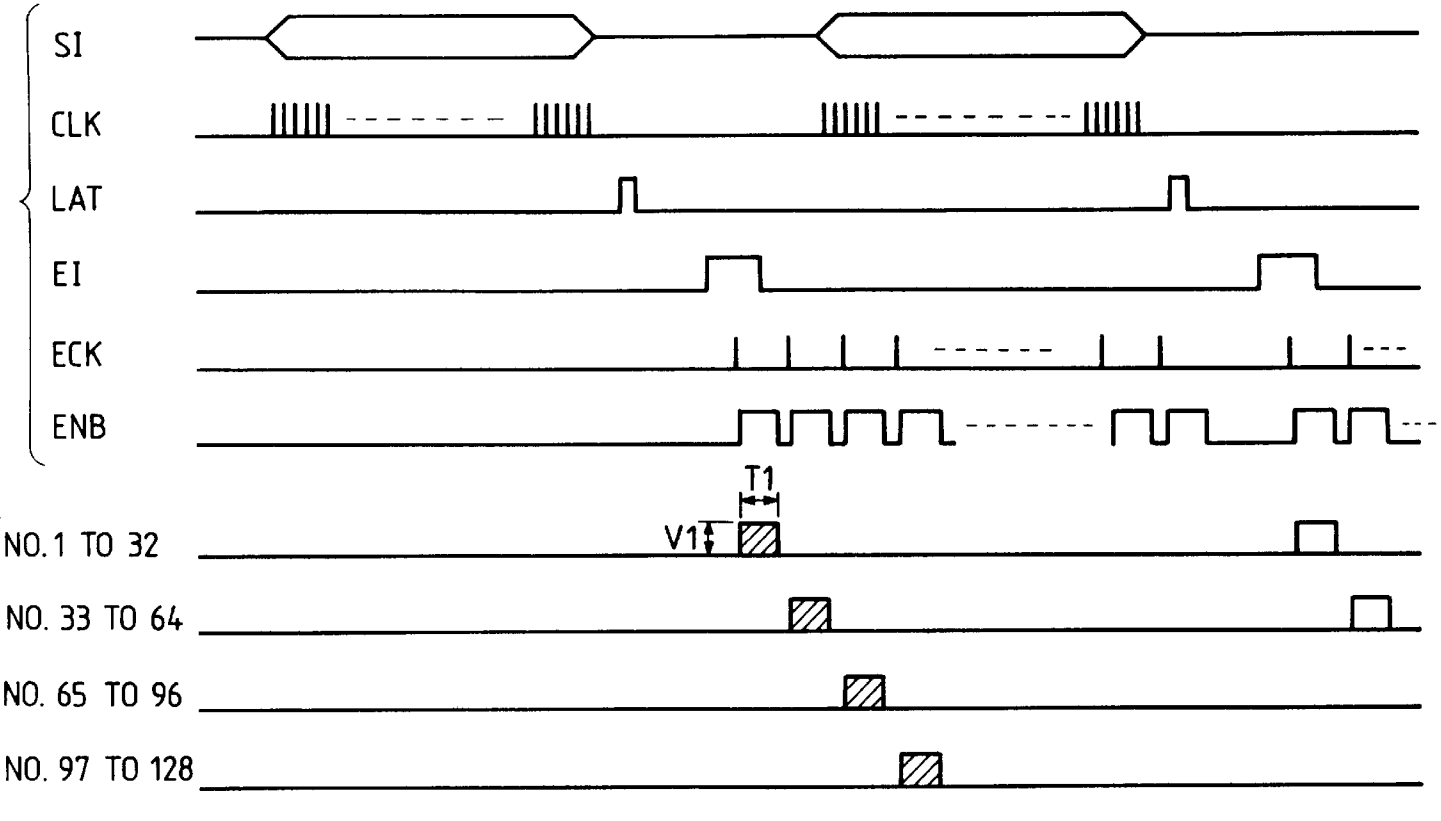
FIG. 8A PRIOR ART
FIG. 8B PRIOR ART
FIGS. 8A and 8B show drive timing charts of the prior art ink jet recording apparatus.

FIG. 7 shows an electrical block diagram of an example of a prior art ink jet recording apparatus. Numeral 50 denotes a recording head control unit of the recording apparatus, numeral 51*a* denotes a block of an electrical circuit of a recording head, numeral 510 denotes a heater and numeral 514 denotes an AND circuit. FIGS. 8A and 8B show timing charts of an example of drive method of the prior art ink jet recording apparatus. The detail of the drive pulse is explained with reference to FIGS. 8A and 8B. A recording timing signal (a) and record data corresponding to a record density are applied to the head drive-circuit. By the recording timing signal (A), a rectangular pulse having a voltage V1 and a width T1 is applied to the heater 104 of FIG. 1 at (B). This pulse has sufficient voltage and width to cause the applied electrical energy to generate bubbles in the nozzle 106 so that the ink is discharged from the discharge port 102.

Figure 6A:
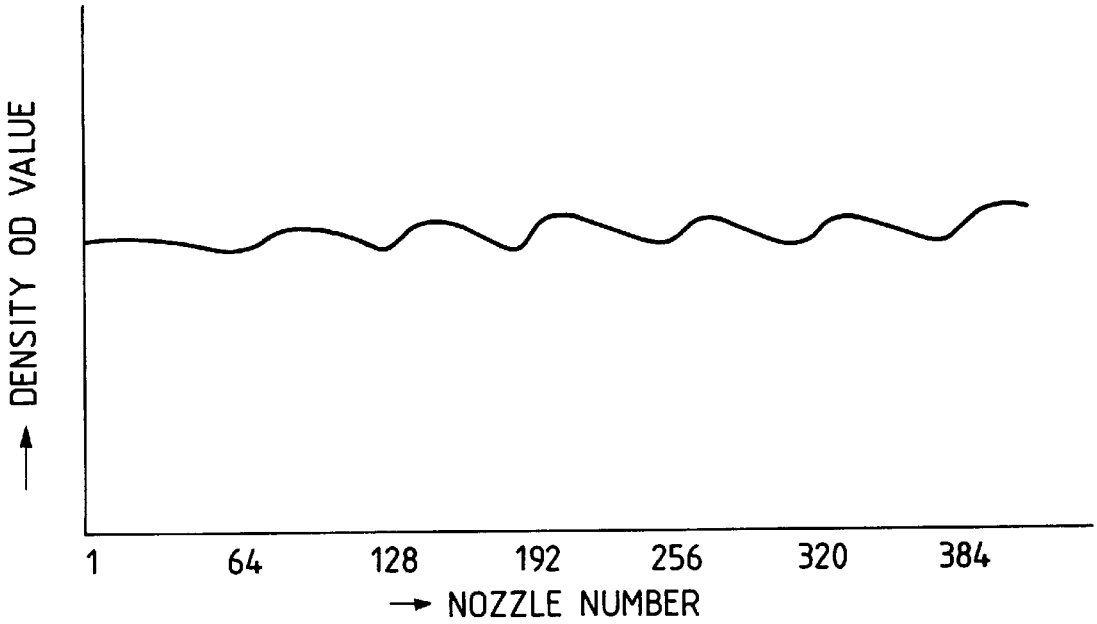
FIG. 6A PRIOR ART
FIGS. 6A and 6B illustrate irregularity of density in a recorded image generated by the recording head and time-division drive.
Figure 6B:
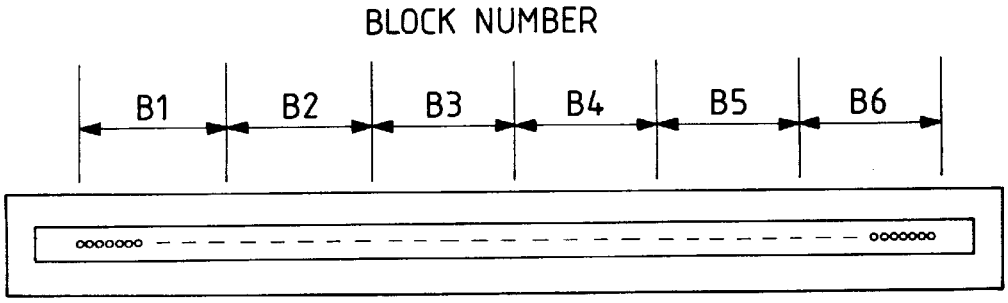
FIG. 6B PRIOR ART

In the prior art, when the time division drive is adopted, the optical density irregularity appears in the recorded image as shown by a graph in FIG. 6A by the mechanism described above. In FIG. 6A, an abscissa represents nozzle position number in the nozzle array of the bubble jet recording head shown in FIG. 6B, and B1, B2, B3, . . . shown in FIG. 6B denote blocks of the time division drive. In the example shown in FIG. 6B, the blocks B1, B2, B3, . . . are driven in sequence from the left to the right.

Figure 9:
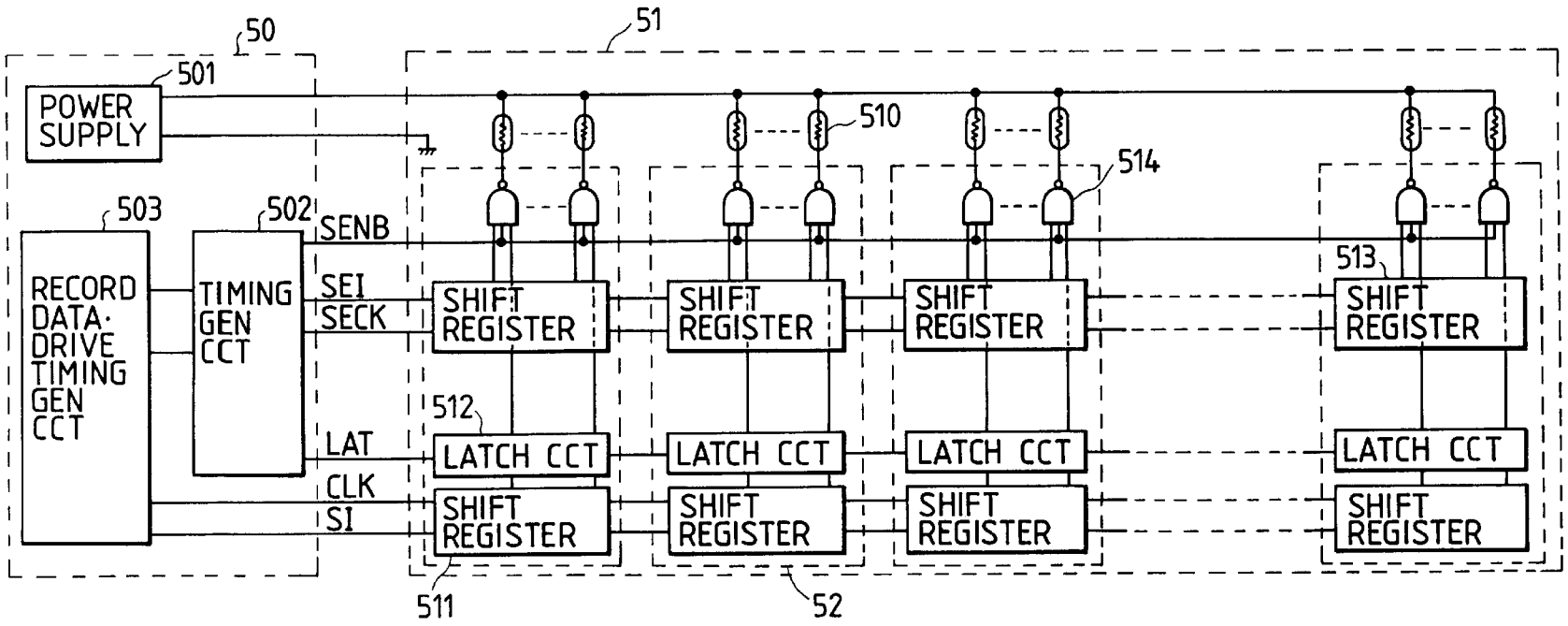
FIG. 9 shows an electrical block diagram of an Embodiment 1.

FIG. 9 shows a block diagram (corresponding to FIG. 7) of an electrical configuration of the ink jet recording apparatus of the present embodiment. Numeral 50 denotes a recording head control unit of the recording apparatus, numeral 51 denotes an electrical circuit block of the bubble jet recording head of the present embodiment, and numeral 501 denotes a power supply. Record data SI and a record data transfer clock CLK generated by a record data/drive timing generation circuit 503 are transferred to a record data transfer shift register 511 which is integrated in a head drive IC 52 mounted on the bubble jet recording head 51. The transferred record data SI is latched by a latch circuit 512 of the head drive IC 52 by a signal LAT generated by the timing generation circuit 502 of the head control unit of the recording apparatus.

Head drive signals SENB, SEI and SECK are generated by the timing generation circuit 502 of the recording head control unit 50 of the recording apparatus. The signal SENB allows the energization of the heater 510 of the bubble jet recording head, the signal SEI defines the energization time of the heater, and the signal SECK defines the energization time of the heater 510 together with the signal SEI and it is transferred as an energization control signal for the next adjacent heater by a drive shift register 513 integrated in the drive IC 52 of the recording head 51. The heater 510 is driven by the logical AND of an output signal of the shift register 513 driven by the signals SECK and SEI, the signal SENB and the record data (an output of the latch circuit 512).

Figures 10A, 10B:
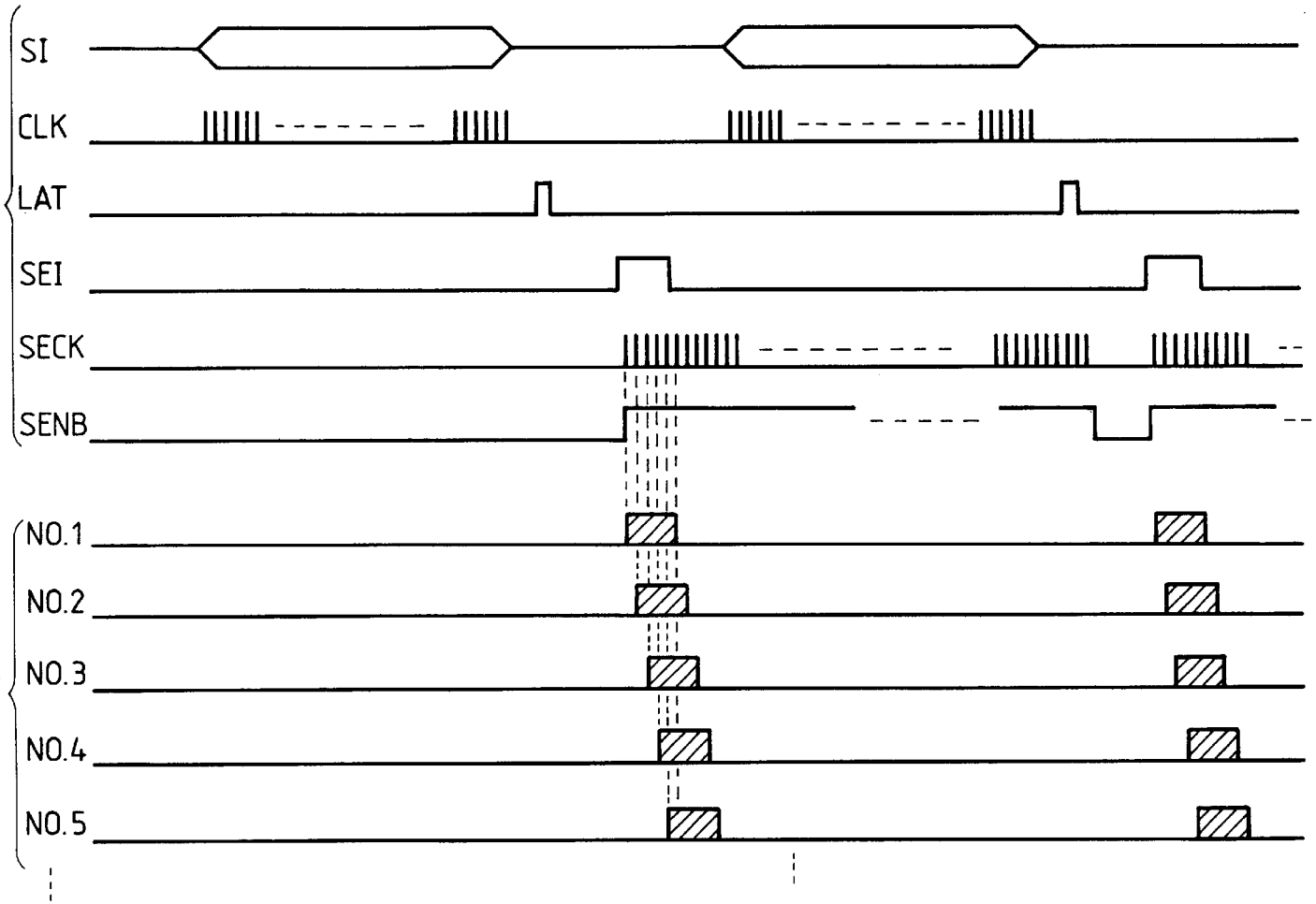
FIGS. 10A and 10B show drive timing charts of the Embodiment 1.

FIGS. 10A and 10B show timing charts illustrating a relation between the signals and the energization of the heaters #1, #2, . . . (or No. 1, No. 2, . . . ) of the present embodiment. As seen from FIGS. 10A and 10B, the drive signals for the adjacent heaters such as the heaters #1 and #2 are delayed by one clock pulse width of SECK, and they are supplied continuously, that is, in a partially overlapped manner. In the present embodiment, the drive signals for up to five heaters overlap. Namely, the five heaters are driven concurrently. The overlap may be controlled by the frequency of the clock SECK and can be determined in accordance with the degree of crosstalk and the capacity of the power supply which permits the concurrent drive.

In the present embodiment, the adjacent nozzles are not divided into large blocks but they are continuously driven. Thus, the boundaries of the blocks are eliminated and the optical density irregularity as seen in the prior art apparatus is prevented. Namely, the image quality of the recording medium having the ink deposited thereon is improved.

<Embodiment 2>

Figure 11:
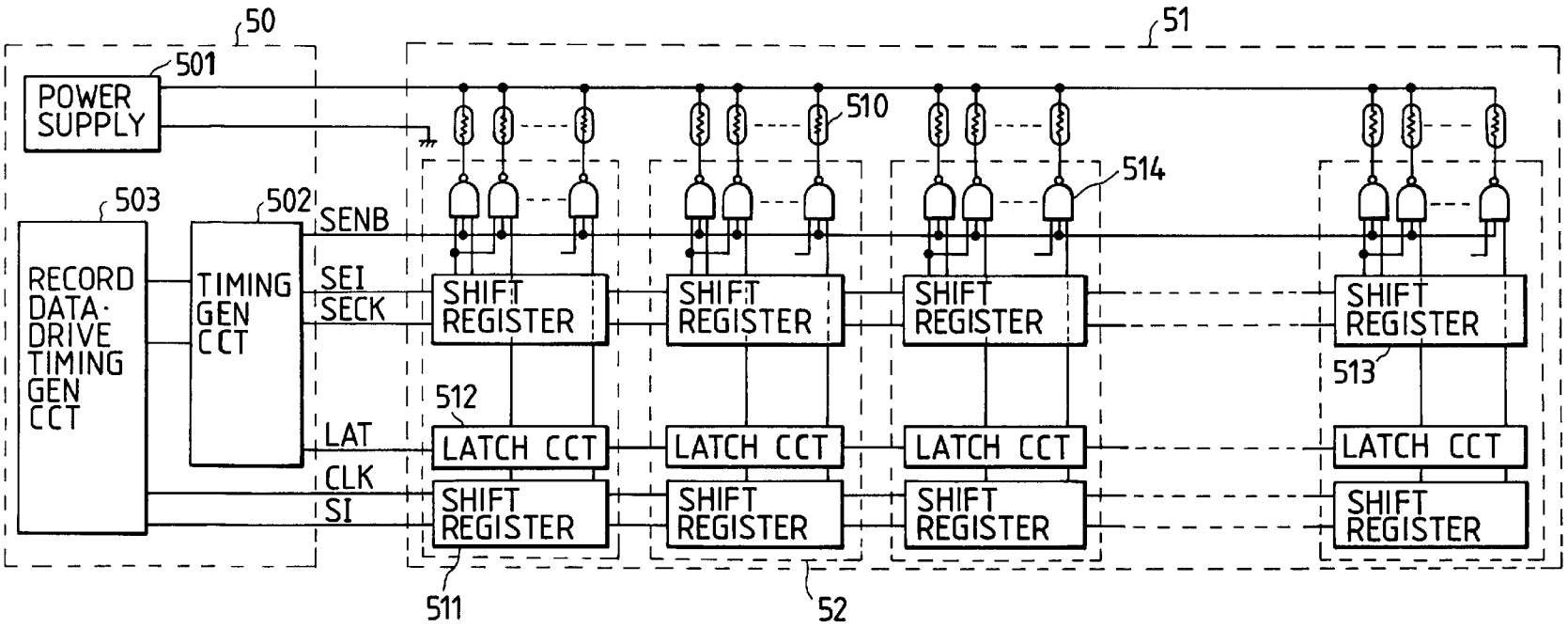
FIG. 11 shows an electrical block diagram of an Embodiment 2.

FIG. 11 shows a diagram of an Embodiment 2 which corresponds to FIG. 9 of the Embodiment 1. Like in FIG. 9, numeral 50 denotes a recording head control unit of the recording apparatus and numeral 51 denotes an electrical circuit block of a bubble jet recording head of the present embodiment. The like elements of FIG. 11 to those of FIG. 9 are not explained here. In this embodiment, an output signal of a shift register 513 are applied to two adjacent heaters and heaters are driven by two at a time.

Figures 12A, 12B:
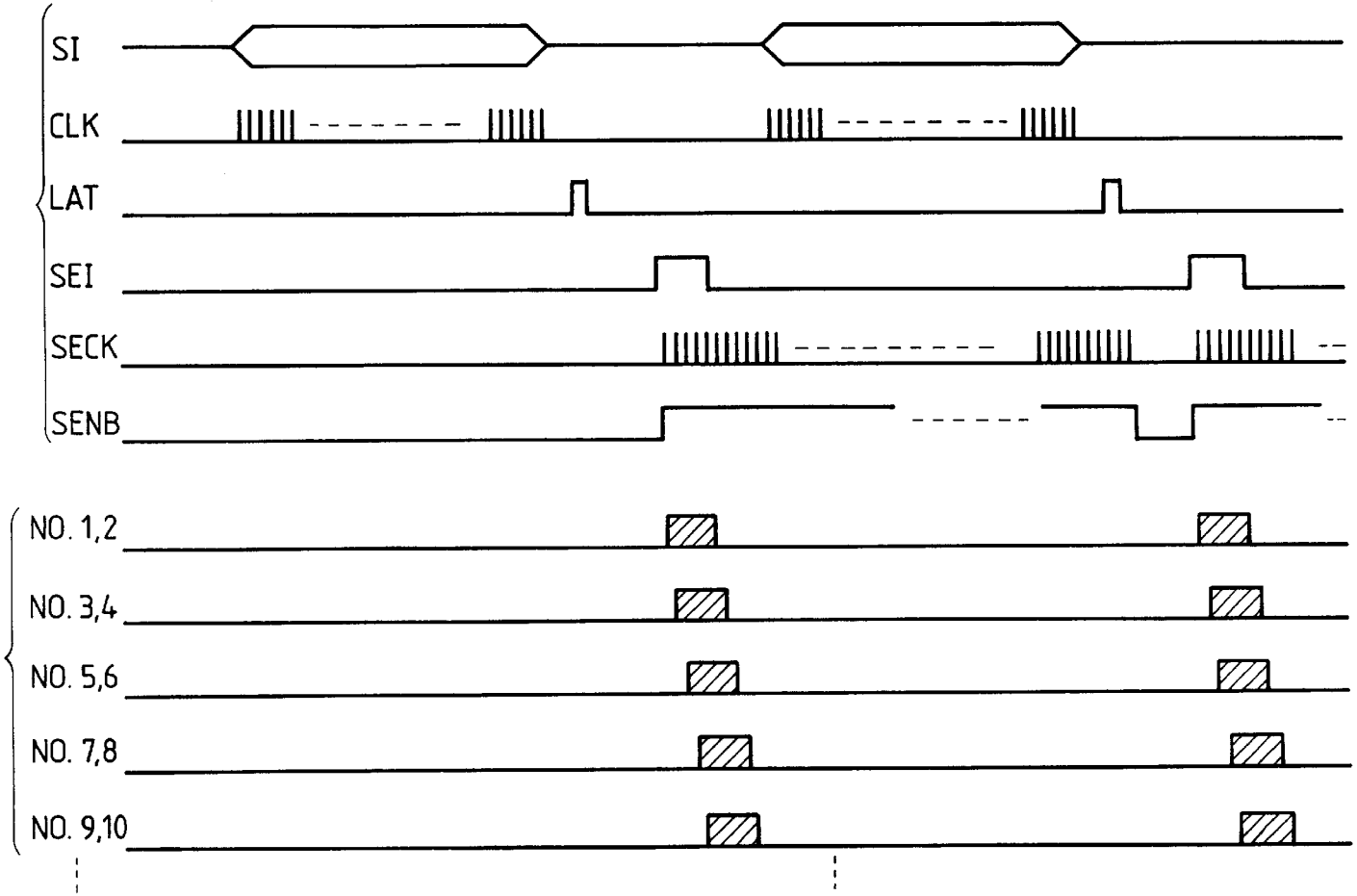
FIGS. 12A and 12B show operation timing charts of the Embodiment 2.

FIGS. 12A and 12B show timing charts (corresponding to FIGS. 10A and 10B) illustrating a relation between various signals and the energization of the heaters #1, #2, . . . of the Embodiment 2. As shown in FIGS. 12A and 12B, the drive signals of the two adjacent heaters such as #1 and #2 are delayed by the time corresponding to one clock pulse width of SECK and they are supplied continuously, that is, in a partially overlapped manner.

In the present embodiment, the two adjacent nozzles are concurrently driven and the adjacent nozzles are not divided into large blocks but they are driven continuously. As a result, the border of the blocks is eliminated and the optical density irregularity which occurs in the prior art is prevented. In the present embodiment, since two nozzles are driven concurrently, the drive is conducted in a shorter time than the Embodiment 1. A number of nozzles corresponding to a width which cannot be visually recognized, for example, 3 to 8 heaters may be concurrently energized although the number may change depending on the nozzle density of the recording head. The number of heaters concurrently driven is also determined by the capacity of the power supply which allows the concurrent energization and the degree of crosstalk.

<Embodiment 3>

Figure 13A:
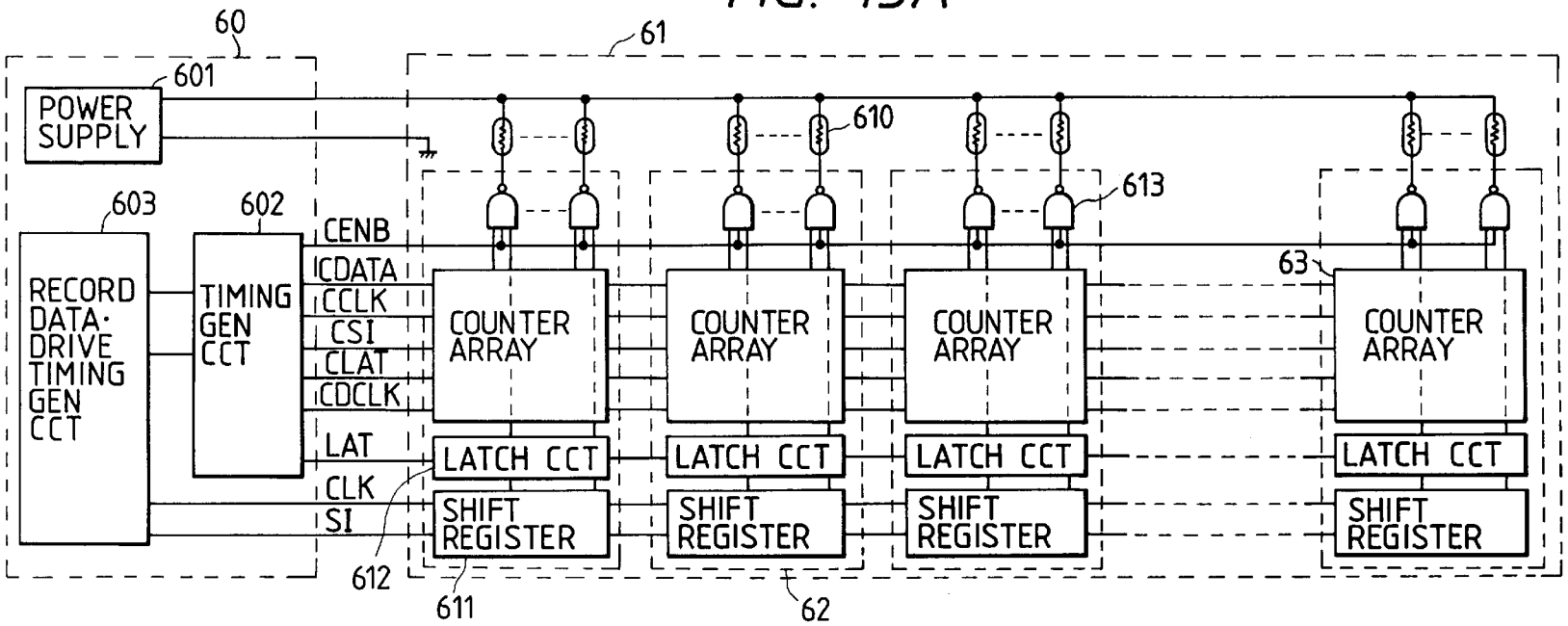
FIGS. 13A and 13B show an electrical block diagram of an Embodiment 3.
Figure 13B:
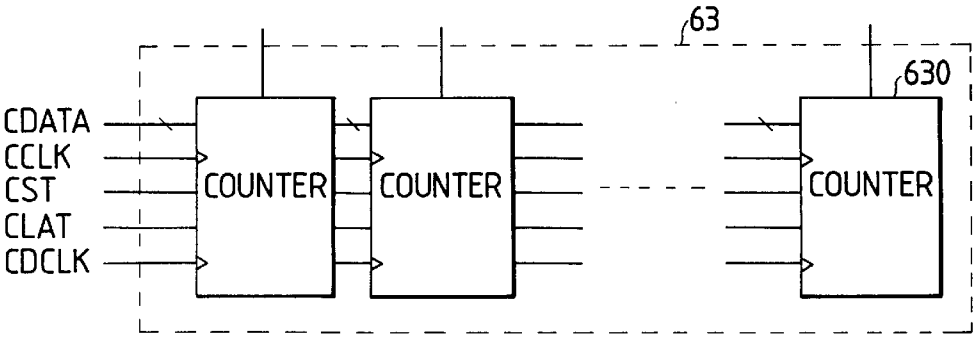

FIG. 13A shows a block diagram (corresponding to FIG. 9) of an electrical configuration of an ink jet recording apparatus of an Embodiment 3. FIG. 13B shows a block diagram of a drive counter array 63. In the Embodiment 3, the energization times of the respective heaters are separately set to compensate the irregularity of the quantity of discharges of the nozzle.

In FIG. 13A, numeral 60 denotes a recording head control unit of the recording apparatus and numeral 61 denotes an electrical circuit block of a bubble jet recording head of the present embodiment. The like elements in FIGS. 13A and 13B to those of FIG. 9 are not explained here.

Head drive signals CENB, CDATA, CCLK, CST, CLAT and CDCLK are generated by the timing generation circuit 602 of the recording head control unit 60 of the recording apparatus. The signal CENB allows the energization of the heater 610 of the bubble jet recording head, and the s signal CDATA defines the energization time of the heater and it is transferred to counter array 63 in synchronism with the signal CDCLK and preset in a presettable counter 630 by the signal CLAT. The presettable counter 630 is triggered by a count start signal CST transferred in synchronism with the signal CCLK to count the CCLK signal by the number corresponding to the value of the preset CDATA and sets the output signal to "1" during the count. The count start signal CST is shifted in synchronism with the CCLK signal and sequentially triggers the start of count of the adjacent presettable counters 630.

Figures 14A, 14B:
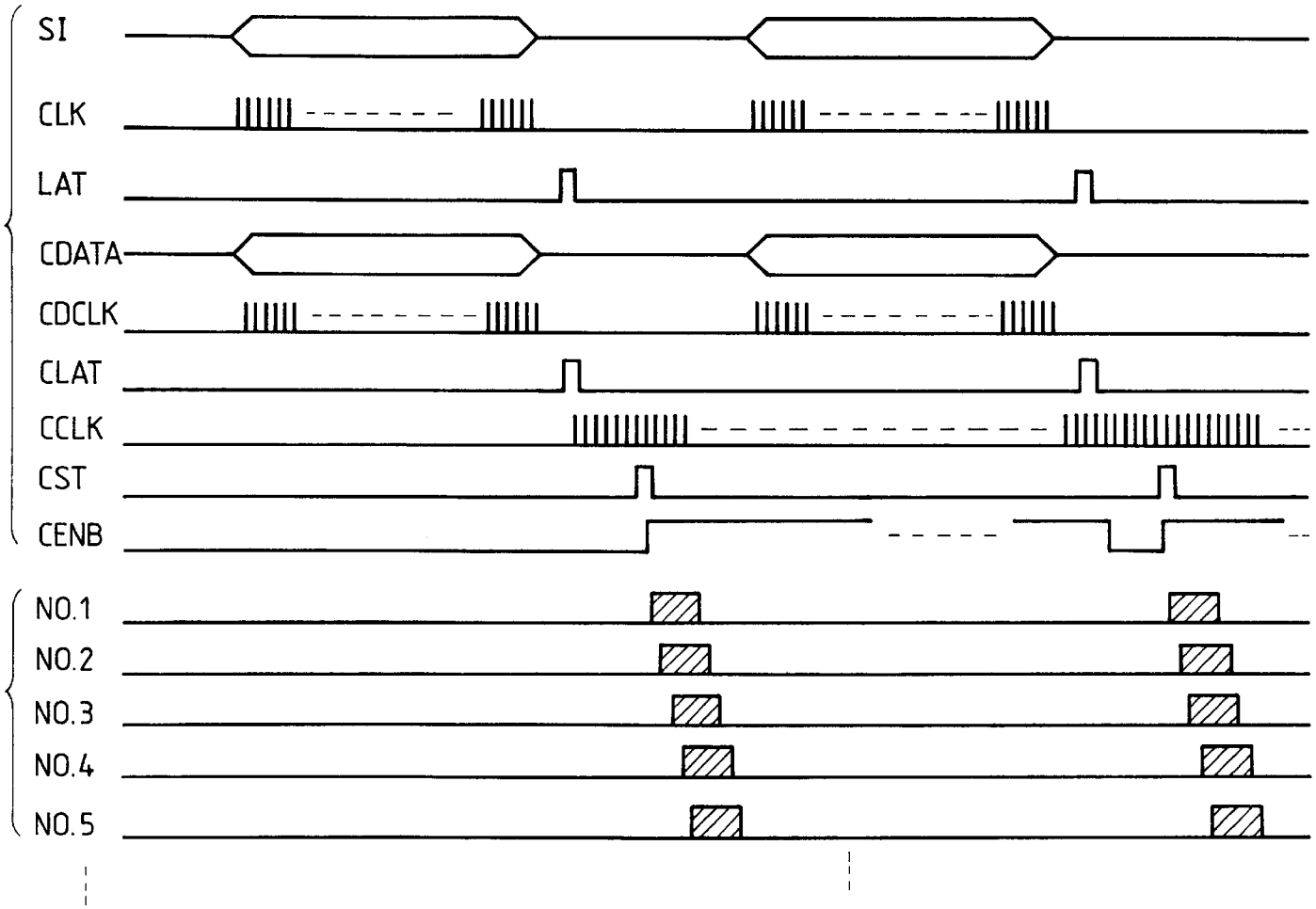
FIGS. 14A and 14B show drive timing charts of the Embodiment 3.

FIGS. 14A and 14B show timing charts (corresponding to FIGS. 10A and 10B) illustrating a relation between various signals and the energization of the heaters #1, #2, . . . of the Embodiment 3. As shown in FIGS. 14A and 14B, the drive of the adjacent heaters is delayed by a time corresponding to one clock pulse width of CCLK and they are driven continuously, that is, in a partially overlapped manner.

In the Embodiment 3, the adjacent nozzles are not divided into large blocks but they are continuously driven to eliminate the border of the blocks so that the optical density irregularity in the recorded image which occurred in the prior art is prevented.

<Other Embodiments>

The above embodiments may be implemented exclusively or in combination, for example by combining the Embodiments 2 and 3. Namely, two heaters are concurrently energized and the energization times of the respective heaters are separately set. While the bubble jet recording technique is explained in each of the embodiments, the present invention may also be applied to a piezo-electric ink jet recording technique or thermal recording.

Figure 15A:
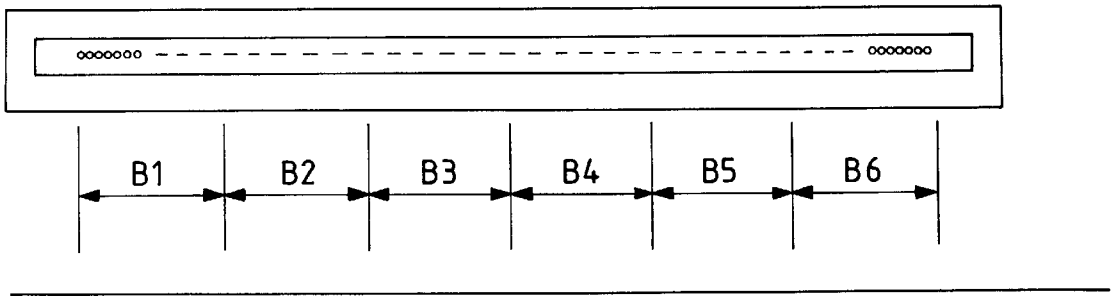
FIGS. 15A to 15D show comparison of registration shift between the prior art and the recording by the present invention.
Figure 15B:
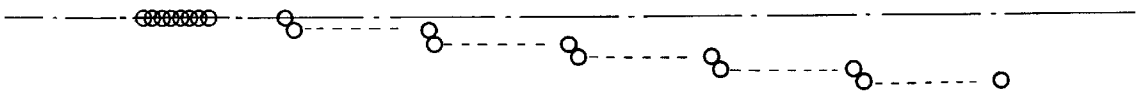
Figure 15C:
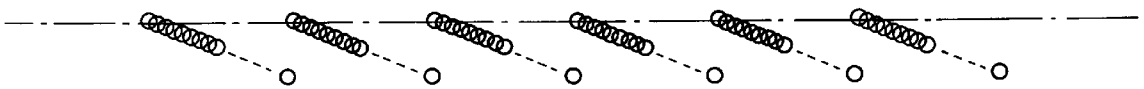
Figure 15D:
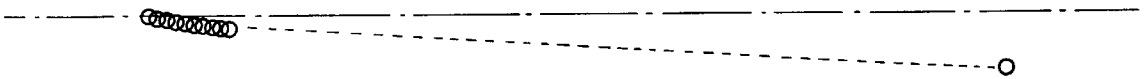

Referring to FIGS. 15A to 15D, the improvement of the quality of the recorded image in the respective embodiments is explained. FIG. 15A shows a full line type bubble jet recording head as viewed in the axis of a nozzle orifice. FIG. 15B shows a step of a recorded image by the prior art time division drive. FIG. 15C shows a step of the recorded image by the prior art distributed time division drive in which one nozzle in each of blocks B1, B2, . . . are concurrently driven. FIG. 15D shows a recorded image by the present invention.

As seen from FIGS. 15A to 15D, by the continuous or partially overlapped drive of the present invention, the registration shift (step) on the recorded image which occurred in the prior art time division drive due to the drive interval between the blocks is eliminated.

In accordance with the present invention, the registration shift on the recorded image is prevented. In the ink jet recording, the adjacent nozzles are not divided into large blocks but they are continuously driven so that the optical density irregularity of the recorded image by the mutual interference of the nozzles is eliminated.

The present invention is particularly suitably usable in an ink jet recording head and a recording apparatus in which thermal energy by an electro-thermal transducer, a laser beam or the like is used to cause a change of state of the ink to eject or discharge the ink. This is because the high density of pixels and high resolution of recording are attained.

The typical construction and the operational principles are preferably the ones disclosed in U.S. Pat. No. 4,723,129 and U.S. Pat. No. 4,740,796. The principle and the structure are applicable to a so-called on-demand type recording system and a continuous type recording system. Particularly, however, it is suitable for the on-demand type because the principle is such that at least one driving signal is applied to an electro-thermal transducer disposed on a liquid (ink) retaining sheet or liquid passage, the driving signal being large enough to provide such a quick temperature rise beyond a departure from nucleation boiling point, by which the thermal energy is provided by the electro-thermal transducer to produce film boiling on the heating portion of the recording head, whereby a bubble can be formed in the liquid (ink) corresponding to each of the driving signals. By the generation, development and contraction of the bubbles, the liquid (ink) is ejected through a discharge port to produce at least one droplet. The driving signal is preferably in the form of pulse because the development and the contraction of the bubbles can be effected instantaneously, and therefore the liquid (ink) is ejected with fast response. The driving signal is preferably such as those disclosed in U.S. Pat. No. 4,463,359 and U.S. Pat. No. 4,345,262. In addition, the temperature rise rate of the heating surface is preferably such as those disclosed in U.S. Pat. No. 4,313,124.

The structure of the recording head may be those shown in U.S. Pat. No. 4,558,333 and U.S. Pat. No. 4,459,600 in which the heating portion is disposed at a bent portion, as well as the structure of the combination of the ejection outlet, liquid passage and the electro-thermal transducer disclosed in the above-mentioned patents. In addition, the present invention is applicable to the structure disclosed in Japanese Laid-Open patent application Ser. No. 59-123670 in which a common slit is used as the discharge port for a plurality of electro-thermal transducers, and the structure disclosed in Japanese Laid-Open patent application Ser. No. 59-138461 in which an opening for absorbing a pressure wave of thermal energy is formed corresponding to the discharge port. This is because the present invention is effective to perform the recording with certainty and high efficiency irrespective of the type of the recording head.

The present invention is effectively applicable to a so-called full-line type recording head having a length corresponding to the maximum recording width and such a recording head may comprise a single recording head or plural recording heads combined to cover the maximum width.

In addition, the present invention is applicable to a serial type recording head in which the recording head is fixed on a main assembly, to a replaceable chip type recording head which is connected electrically with the apparatus and can be supplied with the ink when it is mounted in the main assembly, or to a cartridge type recording head having an integral ink container.

The provision of the recovery means and/or auxiliary means for the preliminary operation are preferable because they further stabilize the effects of the present invention. As for such means, there are capping means for the recording head, cleaning means therefor, pressuring or suctioning means, preliminary heating means which may be an electro-thermal transducer, an additional heating element or a combination thereof. Also, means for effecting preliminary discharge (not for the recording) may stabilize the recording operation.

As regards the variation of the recording head mountable, it may be a single head for a single color or plural heads for a plurality of inks having different colors or densities. The present invention is effectively applicable to an apparatus having at least one of a monochromatic mode mainly with black, a multi-color mode with different color inks and/or full color mode using the mixture of colors, which may be an integrally formed recording unit or a combination of a plurality of recording heads.

Furthermore, in the foregoing embodiment, the ink is liquid. Alternatively, ink which is solidified below a room temperature and liquefied at a room temperature may be used. Since the ink is controlled within a temperature range of not lower than 30° C. and not higher than 70° C. to stabilize the viscosity of the ink to provide the stable discharge in a conventional recording apparatus of this type, the ink may be such that it is liquid within the temperature range when the recording signal is applied. The present invention is also applicable to other type of ink. In one of them, the temperature rise due to the thermal energy is positively prevented by consuming it for the state change of the ink from the solid state to the liquid state. Other ink is solidified when it is left unused, to prevent the evaporation of the ink. In any case, upon the application of the recording signal producing thermal energy, the ink is liquefied, and the liquefied ink may be discharged. Other ink may start to be solidified at the time when it reaches the recording sheet. The present invention is also applicable to the ink which is liquefied by the application of the thermal energy. Such ink may be retained in liquid state or solid state in holes or recesses formed in a porous sheet as disclosed in Japanese Laid-Open patent application No. 54-56847 and Japanese Laid-Open patent application No. 60-71260. The sheet is faced to the electro-thermal transducers. The most effective one of the inks described above is the film boiling system.

The ink jet recording apparatus may be used as an output terminal of an information processing apparatus such as a computer or the like, as a copying machine combined with an image reader or the like, or as a facsimile machine having information sending and receiving functions.

While the invention has been described with reference to the structures disclosed herein, it is not confined to the details set forth and this application is intended to cover such modifications or changes as may come within the purpose of the improvements or the scope of the following claims.

What is claimed is:

1. A recording apparatus for recording by using a recording head having a plurality of recording elements, comprising:

enable signal generation means for generating, in a predetermined period, enable signals for enabling driving of said recording elements; and supply means for receiving an enable signal generated by said enable signal generation means, shifting the received enable signal in a period shorter than the predetermined period and in accordance with a clock signal, and supplying the shifted enable signal to recording element groups, each including one or a plurality of adjacent recording elements of said recording head, said supply means for supplying the shifted enable signal to the adjacent recording element groups in a partially overlapped manner whereby the shifted enable signals partially overlap.

2. A recording apparatus according to claim 1, wherein said generation means receives time data indicating times of the enable signals for respective recording element groups and generates the enable signals of the times corresponding to the time data for the recording element groups.

3. A recording apparatus according to claim 1, wherein each of the recording elements of said recording head comprises a discharge port for discharging ink and an energy generation element for discharging the ink.

4. A recording apparatus according to claim 3, wherein said recording head comprises flow paths communicating with plural discharge ports and a common liquid chamber to which the flow paths commonly communicate.

5. A recording apparatus according to claim 1, wherein said recording head comprises a number of recording elements corresponding to a recording width of a recording medium.

6. A recording apparatus according to claim 1, wherein said recording head is capable of recording a plurality of colors.

7. A recording apparatus according to claim 1, wherein said recording head discharges ink by using thermal energy.

8. A recording apparatus according to claim 1, further comprising feed means for feeding a recording medium recorded by said recording head.

9. A recording apparatus according to claim 1, wherein said recording apparatus is applied to a copying machine.

10. A recording apparatus according to claim 1, wherein said recording apparatus is applied to a facsimile machine.

11. A recording apparatus according to claim 1, wherein said recording apparatus is applied to a terminal device of a computer.

12. A recording method for recording by using a recording head having a plurality of recording elements, comprising the steps of:

generating, in a predetermined period, enable signals for enabling driving of said recording elements;

receiving an enable signal generated in said generating step;

shifting the received enable signal in a period shorter than the predetermined period and in accordance with a clock signal; and supplying the shifted enable signal to the adjacent recording element groups in a partially overlapped manner, each group including one or a plurality of adjacent recording elements of said recording head.

13. A recording method according to claim 12, wherein said recording head comprises a number of recording elements corresponding to a recording width of a recording medium.

14. A recording method according to claim 12, wherein said recording head is capable of recording a plurality of colors.

15. A recording method according to claim 12, wherein said recording head discharges ink by using thermal energy.

16. An ink jet recording apparatus for recording by discharging ink, comprising:

a recording head having a plurality of discharge ports for discharging the ink, energy generation elements provided one for each discharge port for discharging the ink, flow paths communicating with said discharge ports and a common liquid chamber to which said flow paths commonly communicate;

enable signal generation means for generating, in a predetermined period, enable signals for enabling driving of said recording elements; and supply means for receiving an enable signal generated by said enable signal generation means, shifting the received enable signal in a period shorter than the predetermined period and in accordance with a clock signal, and supplying the shifted enable signal to recording element groups, each including one or a plurality of adjacent recording elements of said recording head, said supply means for supplying the shifted enable signal to the adjacent recording element groups in a partially overlapped manner whereby the enable signals partially overlap.

17. An ink jet recording apparatus according to claim 16, wherein said generation means receives time data indicating times of the enable signals for respective recording element groups and generates the enable signals of the times corresponding to the time data for the recording element groups.

18. An ink jet recording apparatus according to claim 16, wherein said recording head comprises a number of recording elements corresponding to a recording width of a recording medium.

19. An ink jet recording apparatus according to claim 16, wherein said recording head is capable of recording a plurality of colors.

20. An ink jet recording apparatus according to claim 16, wherein said recording head discharges ink by using thermal energy.

21. An ink jet recording apparatus according to claim 16, further comprising feed means for feeding a recording medium recorded by said recording head.

22. An ink jet recording apparatus according to claim 16, wherein said recording apparatus is applied to a copying machine.

23. An ink jet recording apparatus according to claim 16, wherein said recording apparatus is applied to a facsimile machine.

24. An ink jet recording apparatus according to claim 16, wherein said recording apparatus is applied to a terminal device of a computer.

25. A recording method for recording by discharging ink, comprising the steps of:

preparing a recording head having a plurality of discharge ports for discharging the ink, energy generation elements provided one for each discharge port for discharging the ink, flow paths communicating with said discharge ports and a common liquid chamber to which said flow paths commonly communicate;

generating enable signals, in a predetermined period, for enabling driving of said recording elements;

receiving an enable signal generated in said generating step;

shifting the received enable signal in a period shorter than the predetermined period and in accordance with a clock signal; and supplying the shifted enable signal to adjacent recording element groups, each group including one or a plurality of adjacent recording elements of said recording head.

26. A recording method according to claim 25, wherein said recording head comprises a number of recording elements corresponding to a recording width of a recording medium.

27. A recording method according to claim 25, wherein said recording head is capable of recording a plurality of colors.

28. A recording method according to claim 25, wherein said recording head discharges ink by using thermal energy.

29. A recorded product having ink deposited thereon manufactured by a recording method using a recording head, said recording method comprising the steps of:

generating, in a predetermined period, enable signals for enabling driving of recording elements of said recording head;

receiving an enable signal generated in said generating step;

shifting the received enable signal in a period shorter than the predetermined period and in accordance with a clock signal; and supplying the shifted enable signal to adjacent recording element groups in a partially overlapped manner, each group including one or a plurality of adjacent recording elements of said recording head.

* * * * *

UNITED STATES PATENT AND TRADEMARK OFFICE

CERTIFICATE OF CORRECTION

PATENT NO. : 5,988,785

DATED : November 23, 1999

INVENTOR(S) : KATAYAMA

It is certified that error appears in the above-identified patent and that said Letters Patent is hereby corrected as shown below:

[56] References Cited:
FOREIGN PATENT DOCUMENTS, "1285356" should read --1-285356--.

COLUMN 1:
Line 52, "affect to" should read --effect on--.

COLUMN 3:
Line 32, "Ser. No." should read --No.--.

COLUMN 4:
Line 13, "in" should read --in a--.
Line 22, "group" should read --groups--.
Line 23, "partial" should read --partially--.
Line 39, "in" should read --in a--.
Line 53, "group" should read --groups--.
Line 54, "partial" should read --partially--.

COLUMN 5:
Line 3, "group" should read --groups--.
Line 4, "partial" should read --partially--.

COLUMN 6:
Line 25, "drive" should read --the drive--.
Line 38, "nozzle" should read --the nozzle--.

COLUMN 8:
Line 8, "s signal" should read --signal--.
Line 17, "count" should read --the count--.

UNITED STATES PATENT AND TRADEMARK OFFICE

CERTIFICATE OF CORRECTION

PATENT NO. : 5,988,785

DATED : November 23, 1999

INVENTOR(S) : KATAYAMA

It is certified that error appears in the above-identified patent and that said Letters Patent is hereby corrected as shown below:

COLUMN 9:

Line 16, "pulse" should read --a pulse--.
Line 26, "liquid" should read --the liquid--.
Line 29, "Ser. No." should read --No.--.
Line 32, "Ser. No." should read --No.--.
Line 53, "pressuring" should read --pressurizing--.

COLUMN 10:

Line 9, "type" should read --types--.

Signed and Sealed this

Fourteenth Day of November, 2000

*Attest:*

Q. TODD DICKINSON

*Attesting Officer*

*Director of Patents and Trademarks*